US012083399B2

(12) United States Patent
Taylor

(10) Patent No.: US 12,083,399 B2
(45) Date of Patent: Sep. 10, 2024

(54) PORTABLE GOLF CLUB CLEANER

(71) Applicant: Tracy Thomas Taylor, Wilmington, DE (US)

(72) Inventor: Tracy Thomas Taylor, Wilmington, DE (US)

( * ) Notice: Subject to any disclaimer, the term of this patent is extended or adjusted under 35 U.S.C. 154(b) by 340 days.

(21) Appl. No.: 17/653,490

(22) Filed: Mar. 4, 2022

(65) Prior Publication Data

US 2022/0379183 A1 Dec. 1, 2022

Related U.S. Application Data

(60) Provisional application No. 63/193,941, filed on May 27, 2021.

(51) Int. Cl.
*A63B 57/60* (2015.01)
*A46B 5/00* (2006.01)
*A46B 9/02* (2006.01)

(52) U.S. Cl.
CPC ..... *A63B 57/60* (2015.10); *A46B 5/0095* (2013.01); *A46B 9/02* (2013.01); *A46B 2200/3073* (2013.01)

(58) Field of Classification Search
CPC ..... A46B 2200/3073; A46B 5/0095
See application file for complete search history.

(56) References Cited

U.S. PATENT DOCUMENTS 2,744,276 A 5/1956 Chambless
3,872,534 A 3/1975 Hoag
4,821,358 A * 4/1989 Wyckoff ..... A63B 57/60 15/88.1
5,155,883 A 10/1992 Legault
5,168,888 A 12/1992 Altwasser
5,404,610 A 4/1995 Coyer, Sr. et al.
5,560,066 A 10/1996 McDivitt
5,572,761 A 11/1996 Meyer
5,732,435 A 3/1998 Williams et al.
5,742,965 A 4/1998 Leask
5,915,432 A 6/1999 Trummer
5,974,612 A 11/1999 Cathcart
6,021,537 A 2/2000 Smith
6,115,865 A 9/2000 Fado
6,317,916 B1 * 11/2001 Smith ..... B08B 3/04 15/210.1
6,430,770 B1 8/2002 Glass
(Continued)

*Primary Examiner* — Andrew A Horton

(74) *Attorney, Agent, or Firm* — Dunlap Bennett & Ludwig, PLLC

(57) ABSTRACT

A portable golf club cleaning system is provided. The club cleaning system may define two separate cleaning stations, each dimensioned and adapted for different types of clubs. Each cleaning station may be defined, along an upper region, by a stacked arrangement of a top cover panel, a splash guard, and a bottom cover panel that are attached along an opening of a container. Adjacent each cleaning station, inside of the container is a brush assembly providing bristles protruding into the volume defined by each respective cleaning station. After the container is filled with liquid, the clubs can be cleaned by urging them into the respective cleaning station by way of cutouts and associated flaps of the stacked arrangement. A screw-on lid can seal the opening to prevent spillage when transporting the present invention.

6 Claims, 4 Drawing Sheets

(56) References Cited

U.S. PATENT DOCUMENTS

| | | | | |
|---|---|---|---|---|
| 6,745,424 | B1 | 6/2004 | Pimentel et al. | |
| 6,938,296 | B1 * | 9/2005 | Scheuermann ..... | A63B 57/60 15/160 |
| 7,356,868 | B1 | 4/2008 | Herrmann | |
| 9,566,488 | B1 | 2/2017 | Welch | |
| 10,258,847 | B2 | 4/2019 | Loftus | |
| 10,828,537 | B2 | 11/2020 | Smith | |
| 2017/0197124 | A1 | 7/2017 | Perrone | |

* cited by examiner

PORTABLE GOLF CLUB CLEANER

CROSS-REFERENCE TO RELATED APPLICATION

This application claims the benefit of priority of U.S. provisional application No. 63/193,941, U.S. provisional application number filed 27 May 2021, the contents of which are herein incorporated by reference.

BACKGROUND OF THE INVENTION

The present invention relates to golf accessories and, more particularly, a portable golf club cleaner.

Presently, there is nothing on the market that can help a golfer clean their golf club in a sealable container that one can, when not cleaning their golf clubs, safely and confidently take to the driving range, place in a golf cart, or leave in one's vehicle without worrying about the nuisance of spillage. The only tools currently available for cleaning golf clubs are a brush and towel, and, in some instances, there is an iron cleaner that attaches to a golf cart.

Furthermore, current golf club cleaning systems are too big to fit on the golf cart. Additionally, they can only clean irons and not woods/drivers. Moreover, current golf club cleaning systems do not embody a sealable system to protect from spills.

As can be seen, there is a need for a portable golf club cleaner.

The present invention embodies a golf cleaning system that is dimensioned and adapted to clean all types of clubs during or after a round of golf, or anytime at the user's convenience.

The golf cleaning system provides two separate cleaning stations (one for irons and one for woods) and has a lid to prevent spills and odors. The design of the present invention also enables it to fit in a golf cart, take to the driving range, or leave in one's personal vehicle for cleaning after a round of golf.

SUMMARY OF THE INVENTION

In one aspect of the present invention, a portable golf club cleaning system includes the following: a container defining a compartment; a first brush assembly that is disposed within the compartment so as to separate the compartment into a first cleaning station and a second cleaning station; and a plurality of first bristles and a plurality of second bristles protruding from a first side and a second side of the first brush assembly, respectively, and into the first and second cleaning stations, respectively.

In another aspect of the present invention, the portable golf club cleaning system further includes the following: an opening along an upper portion of the container, wherein the opening communicates with the compartment; and a stacked arrangement dimensioned and adapted to attach at or just downward of the opening, wherein the stacked arrangement provides at least one cutout and an operatively associated flap portion adjacent an upper portion of each cleaning station, wherein each flap portion comprises a plurality of spaced apart perforations along a splash guard, wherein the plurality of spaced apart perforations defines a plurality of flaps, wherein the plurality of flaps is movable between a biased closed condition and a deformed open condition; further including a first pair of opposing shoulders along an inner circumference of the compartment, wherein each opposing shoulder provides a receiving slot for removably engaging portions of the first brush assembly, wherein the first brush assembly is a T-shape so that opposing ends of an upper portion of the T-shape is received in a respective receiving slot of the first pair of opposing shoulders; a second brush assembly that is disposed within the compartment adjacent to the second cleaning station; and a plurality of bristles protruding from a side of the second brush assembly and into the second cleaning stations; and further including a second pair of opposing shoulders along the inner circumference of the compartment, wherein each opposing shoulder provides a receiving slot for removably engaging portions of the second brush assembly, wherein the second brush assembly is a T-shape so that opposing ends of an upper portion of the T-shape is received in a respective receiving slot of the second pair of opposing shoulders, wherein the first and second pairs of opposing shoulders are along a first and second chord line offset from a center of the opening, and wherein the stacked arrangement provides a top cover panel; a bottom cover panel; and a splash guard disposed between the top and bottom cover panels, wherein the splash guard defines the pluralities of flaps.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a portable golf club cleaning system. The club cleaning system may define two separate cleaning stations, each dimensioned and adapted for different types of clubs. Each cleaning station may be defined, along an upper region, by a stacked arrangement of a top cover panel, a splash guard, and a bottom cover panel that are attached along an opening of a container. Adjacent each cleaning station, inside of the container is a brush assembly providing bristles protruding into the volume defined by each respective cleaning station. After the container is filled with liquid, the clubs can be cleaned by urging them into the respective cleaning station by way of cutouts and associated flaps of the stacked arrangement. A screw-on lid can seal the opening to prevent spillage when transporting the present invention.

Figure 6:
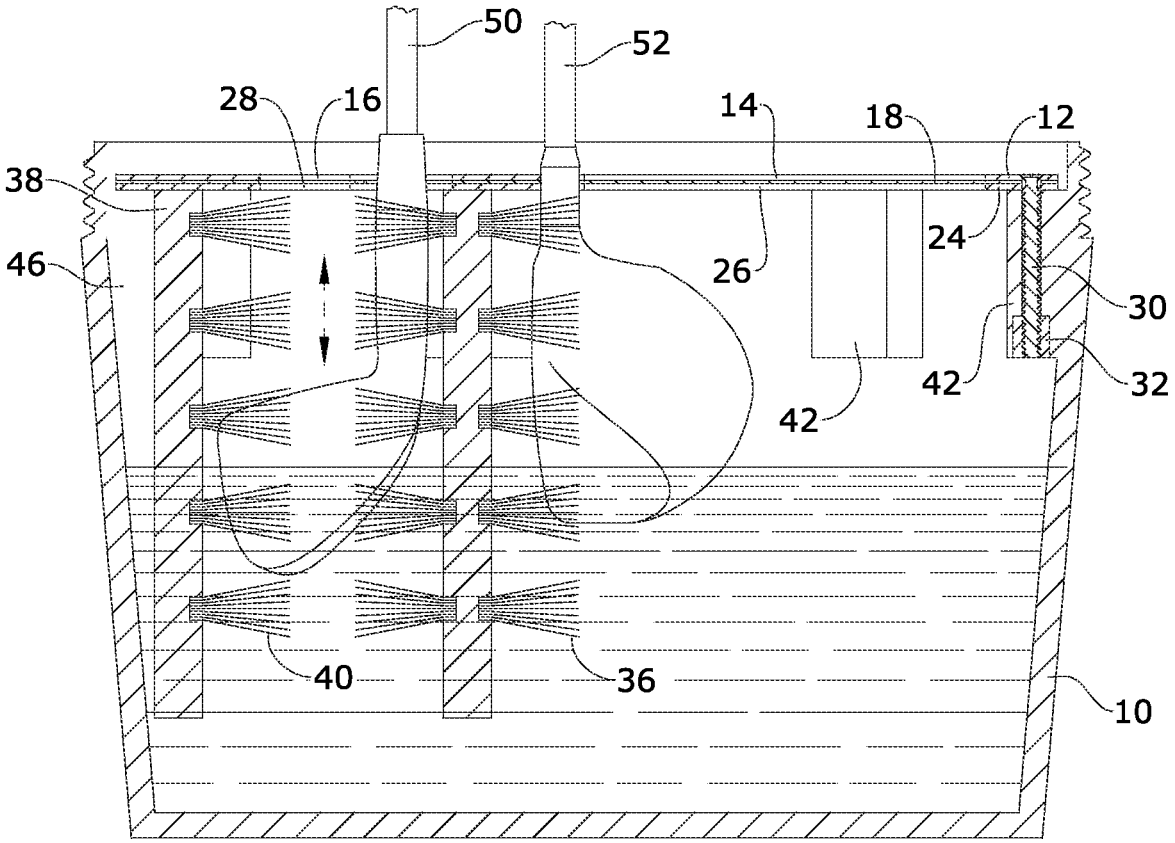
FIG. 6 is the section view of FIG. 5, shown in use with golf clubs being cleaned.

Referring now to FIGS. 1 through 6, the present invention may include a container 10 defining an inner compartment suitable for retaining a liquid 54 therein. The inner compartment is dimensioned and adapted to simultaneously receive two golf heads of any style and standard size, so that the two golf heads are spaced apart and generally occupying separate sub compartments, chambers, or cleaning stations, as illustrated in FIG. 6. Yet the present invention is still dimensioned to be take along in a golf cart.

The container 10 has an opening defined along an upper portion thereof, wherein the opening communicates with the inner compartment. A top cover panel 12 may be dimensioned and adapted to snugly engage an inner circumference of the opening at or just downward of the upper portion of the container 10. The top cover panel 12 may have a first top cutout 14 and a second top cutout 16, each cutout inward of a periphery of the top cover panel 12 and spaced apart from each other as well as being distinguishable in shape from each other.

In certain embodiments, the container 10 may be approximately seven inches tall, with an approximately ten-inch diameter opening, wherein the inner circumference tapers down to an approximately nine-inch diameter base.

A bottom cover panel 24 may have a first bottom cutout 26 and a second bottom cutout 28 that are generally or substantially coextensive with the first top cutout 14 and the second top cutout 16, respectively.

Figure 1:
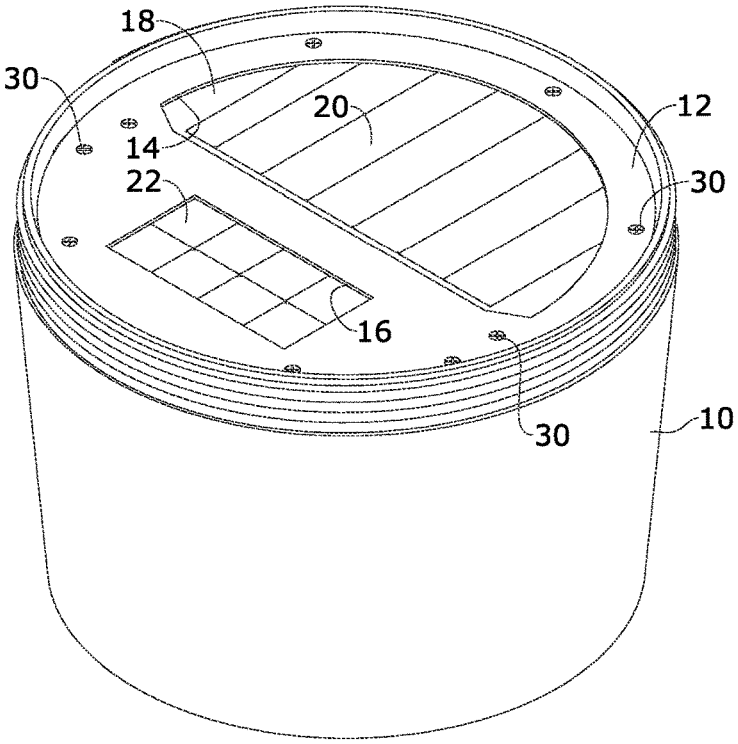
FIG. 1 is a top perspective view of an exemplary embodiment of the present invention.
Figure 2:
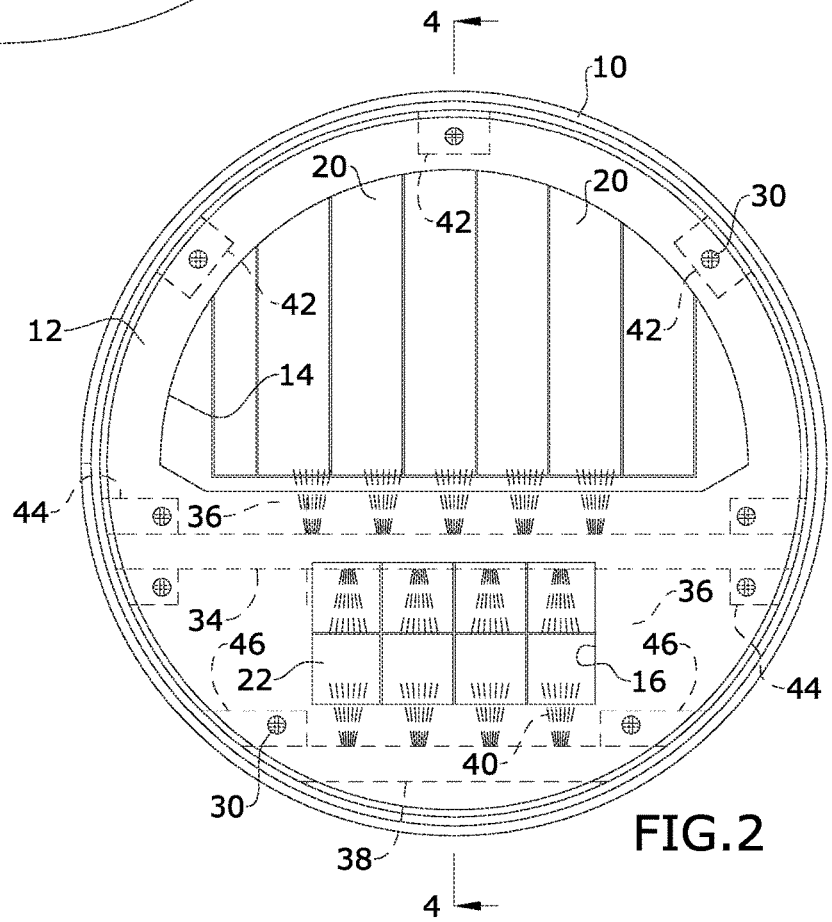
FIG. 2 is a top plan view of an exemplary embodiment of the present invention, showing some internal components in phantom lines to facilitate a greater understanding of the alignment of internal and external components.
Figure 3:
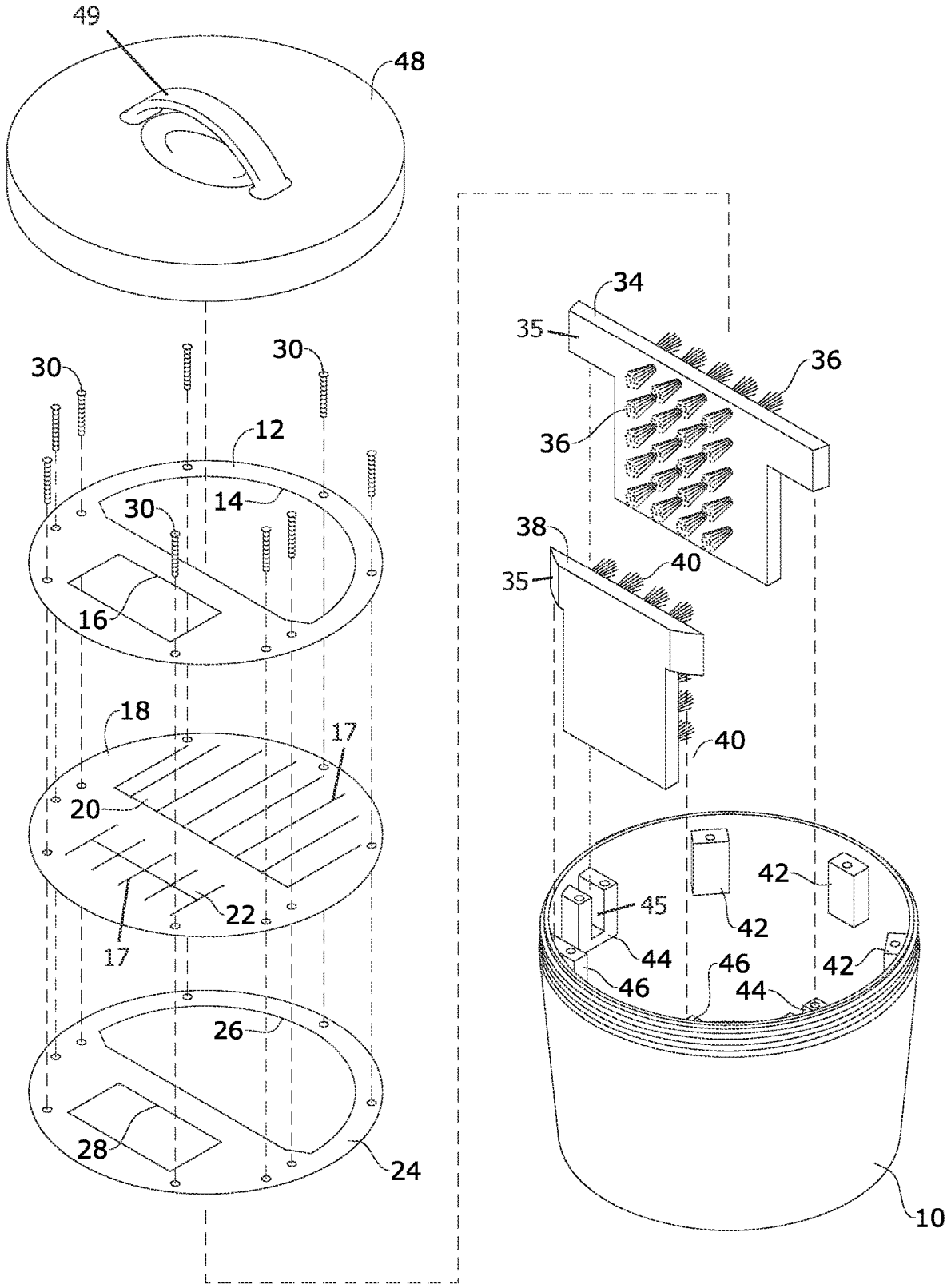
FIG. 3 is an exploded perspective view of an exemplary embodiment of the present invention.
Figure 4:
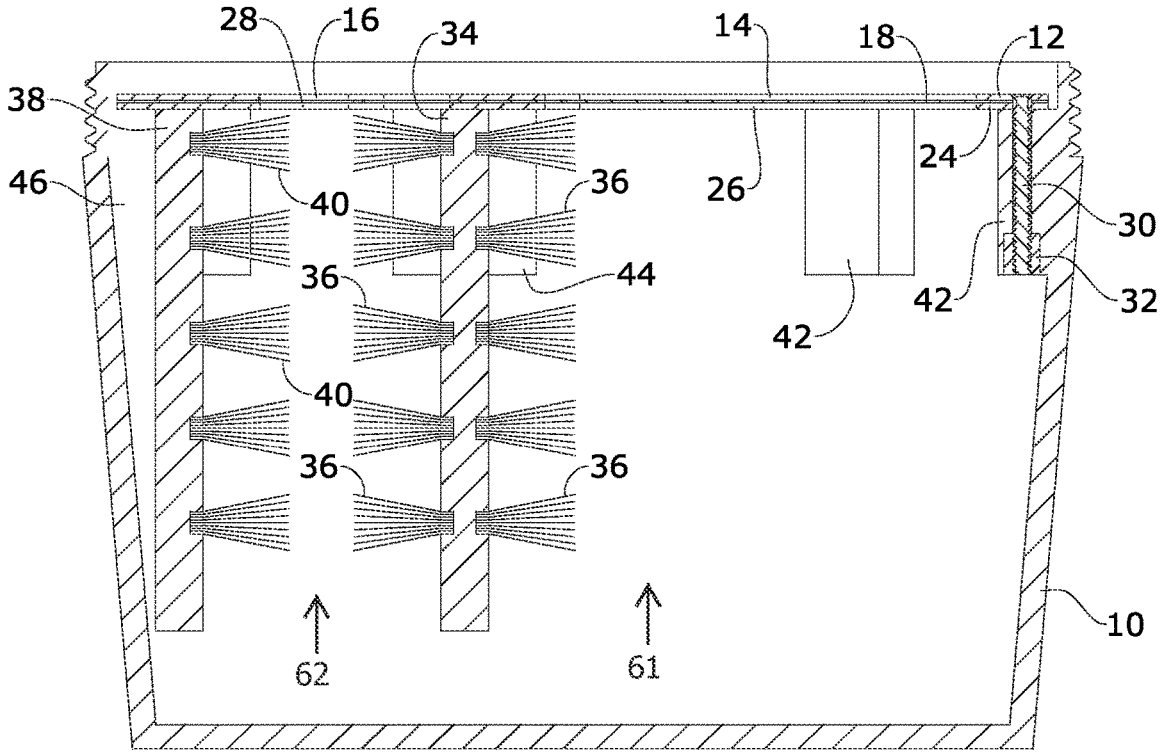
FIG. 4 is a section view of an exemplary embodiment of the present invention, taken along line 4-4 in FIG. 2.
Figure 5:
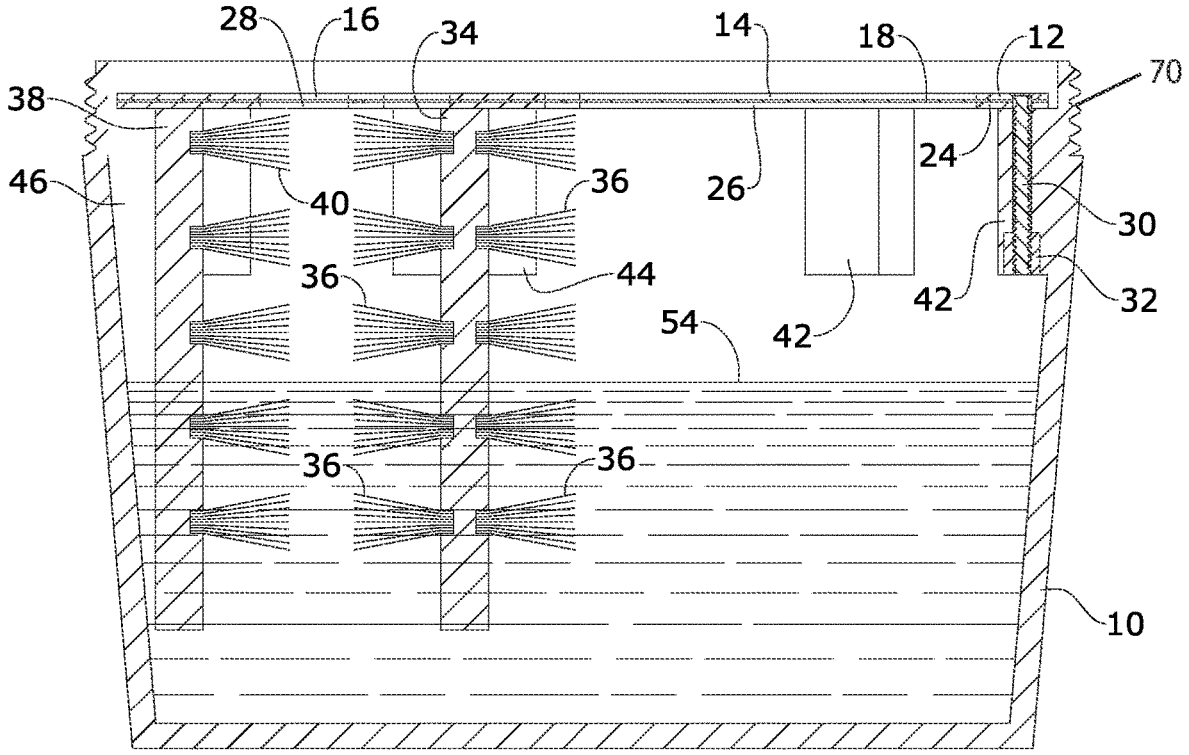
FIG. 5 is the section view of FIG. 4, shown partially filled with liquid 54.

Disposed between the top and bottom cover panels 12 and 24 may be a splash guard 18. The splash guard 18 may have a first flap portion 20 and the second flap portion 22. The first and second flap portions 20 and 22 may have footprint areas that are generally or substantially coextensive with the first top cutout 14 and the second top cutout 16, respectively. Each flap portions 20 and 22 may include a plurality of elongated perforations 17 or cut lines through the material of the splash guard 18, thereby defined a plurality of flaps. The perforations 17 may be in two directions, at least one first direction along the splash guard 18 and a second direction the splash guard 18, the second direction being transverse relative to the first direction, as illustrated in FIG. 3. There may be one perforation 17 in the first direction and a plurality of spaced apart perforations 17 in the second direction. The one linear perforation 17 in the first direction intersects the remaining plurality of second-direction perforations 17 either along their ends or somewhere between their ends. It should be understood that the linearly drawn perforations 17 need not be truly linear as shown in the illustrations, but rather they may be curved or nonlinear as long as they function as disclosed herein.

The perforations 17, in conjunction with the material of the flap portions 20 and 22, are adapted to bias the resulting plurality of flaps in a planar orientation relative to the remainder of the splash guard 18 (through the elasticity of the material, for instance); though, upon sufficient urging on one or more of the perforations 17 by way of, say, a golf club 50 or 52, one or more of the plurality of the flaps will deform and bend to a transverse orientation enabling the golf club 50 or 52 to pass through the plurality of flaps.

In a stacked arrangement, the top cover panel 12, the splash guard 18, and the bottom cover panel 24, respectively, provide that the first and second cutouts/flap portions align. The stacked arrangement may be connected at the opening by way of a plurality of mounting brackets 42 spaced along the inner circumference of the container 10 and fasteners 30 (e.g., threaded fasteners) and 32 (e.g., press-fit fasteners) that removably join the stacked arrangement and the mounting brackets 42 and shoulders' 44 and 46, whereby the mounting brackets 42 and shoulders 44 and 46 may act as shelves.

Also along said inner circumference may be two pairs of shoulders 44 and 46. Each pair of shoulders 44 and 46 may be opposed along a chord line (or secant line) that does not pass through the center of the opening. These two chord lines are disposed to be adjacent to the first and second aligned cutouts/flap portions, respectively. Each pair of shoulders 44 and 46 may have a U-shape defining a receiving slot 45.

The present invention further includes first brush assembly 34 and a second brush assembly 38. Each brush assembly 34 and 38 has a generally T-shape. The T-shape defines two opposing lateral structures 35 dimensioned and adapted to slidably be received and removed from the receiving slot 45 of the respective pair of shoulders 44 or 46. The body portion of the T-shape of the first brush assembly 34 may have bristles 36 on both sides. The body portion of the T-shape of the second brush assembly 38 may have bristles 40 only on one side thereof. These body portions are adjacent their respective cleaning station or chamber vertically aligned with the respective cutouts/flap portions.

The bristles 36 of a first side of the first brush assembly 34 protrude into a first cleaning station 61. The bristles 36 of a second side of the first brush assembly 34 protrude into a second cleaning station 62. The bristles 40 of the second brush assembly 38 protrude into the second cleaning station 62. The second cleaning station bristles 36 and 40 may be dimensioned and adapted so that their respective distal ends are spaced apart from each other.

The body portion of the T-shape of the first brush assembly 34 may have an approximately 9.8-inch length and be approximately five-inch in width. The body portion of the T-shape of the second brush assembly 38 may have an approximately six-inch length and be approximately five-inch in width.

In use, the compartment may be partially filled with a liquid 54 that may include water, liquid cleansers (e.g., soap), and the like. Then a user may urge a head of a larger golf club 52, such as a driver, through the first set of cutouts and flap portions 14, 26, and 20, and into the first cleaning station area 61. Therein the head may engage the bristles 36 of the first brush assembly 34 while the head moves in and out of the liquid 54. Simultaneously or thereafter, the user may urge a smaller golf club 50, such as an iron, through the second set of cutouts and flap portions 16, 28, and 22 so that head engages the bristles 40 of the second brush assembly 38 and/or the bristles 36 of the first brush assembly, while the head moves in and out of the liquid 54. The splash guard 18 flap portions 20 and 22 prevent splashing from escaping the opening during this cleaning process. The user manually, using an up-and-down motion to scrub the golf club, cleans each club type in their separate cleaning stations/chambers. Additionally, the present invention could be used to clean other tools and equipment having a head at the end of an elongated handle.

After use, the user may close off the opening with a screw-on lid 48 to further prevent spillage of the liquid. Along an interior circumference of the lid 48 there may be female threading that engages male threading 70 along the exterior circumference of the upper portion of the container 10, facilitating a watertight seal between the lid 48 and the container 10. The lid 48 may have a handle 49, whereby the lid 48 once sufficient secured to the upper portion of the contain 10 may be manually carried from golf cart to personal vehicle to residence.

A method of making the present invention may include the following. The container may be made of various plasticized materials which are formed through injection molding or additive manufacture. The three-piece cover panels/guards may be cut from thin plastic sheets (for the panels) and the splash guard cut from a thin rubber sheet. The fastener can be purchased over the counter.

As used in this application, the term "about" or "approximately" refers to a range of values within plus or minus 10% of the specified number. And the term "substantially" and "generally" refers to up to 90% or more of an entirety (e.g., substantially coextensive may be 90 to 110% coextensive). The words "about," "approximately," or the like, when accompanying a numerical value, are to be construed as indicating a deviation as would be appreciated by one of ordinary skill in the art to operate satisfactorily for an intended purpose.

Recitation of ranges of values herein are not intended to be limiting, referring instead individually to any and all values falling within the range, unless otherwise indicated, and each separate value within such a range is incorporated into the specification as if it were individually recited herein. Ranges of values and/or numeric values are provided herein as examples only, and do not constitute a limitation on the scope of the described embodiments.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary. Directional terms "top" and "upper" (upward) as well as terms "bottom", "downward" can be ascertained from the Figures, wherein the upward direction is toward the upper margin of FIG. 6, while the downward direction is toward the bottom margin thereof.

It should be understood, of course, that the foregoing relates to exemplary embodiments of the invention and that modifications may be made without departing from the spirit and scope of the invention as set forth in the following claims.

What is claimed is:

1. A portable golf club cleaning system, the system comprising:

a container defining a compartment;

a first brush assembly that is disposed within the compartment so as to separate the compartment into a first cleaning station and a second cleaning station;

a plurality of first bristles and a plurality of second bristles protruding from a first side and a second side of the first brush assembly, respectively, and into the first and second cleaning stations, respectively;

an opening along an upper portion of the container, wherein the opening communicates with the compartment; and a stacked arrangement dimensioned and adapted to attach at or just downward of the opening, wherein the stacked arrangement provides at least one cutout and an operatively associated flap portion adjacent an upper portion of each cleaning station, wherein each flap portion comprises a plurality of spaced apart perforations along a splash guard, wherein the plurality of spaced apart perforations defines a plurality of flaps, wherein the plurality of flaps is movable between a biased closed condition and a deformed open condition; and a first pair of opposing shoulders along an inner circumference of the compartment, wherein each opposing shoulder provides a receiving slot for removably engaging portions of the first brush assembly, wherein the first brush assembly is a T-shape so that opposing ends of an upper portion of the T-shape are received in a respective receiving slot of the first pair of opposing shoulders.

2. The system of claim 1, further comprising a second brush assembly that is disposed within the compartment adjacent to the second cleaning station; and a plurality of bristles protruding from a side of the second brush assembly and into the second cleaning stations.

3. The system of claim 2, further comprising a second pair of opposing shoulders along the inner circumference of the compartment, wherein each opposing shoulder provides a receiving slot for removably engaging portions of the second brush assembly.

4. The system of claim 3, wherein the second brush assembly is a T-shape so that opposing ends of an upper portion of the T-shape is received in a respective receiving slot of the second pair of opposing shoulders.

5. The system of claim 3, wherein the first and second pairs of opposing shoulders are along a first and second chord line offset from a center of the opening.

6. The system of claim 5, wherein the stacked arrangement comprises:

a top cover panel;

a bottom cover panel; and a splash guard disposed between the top and bottom cover panels, wherein the splash guard defines the pluralities of flaps.

* * * * *